US009630419B2

(12) United States Patent
Hong et al.

(10) Patent No.: US 9,630,419 B2
(45) Date of Patent: Apr. 25, 2017

(54) MAINTENANCE VALVE FOR FLUID EJECTION HEAD

(71) Applicant: FUNAI ELECTRIC CO., LTD., Daito-shi, Osaka (JP)

(72) Inventors: Eunki Hong, Lexington, KY (US); Burton L. Joyner, Lexington, KY (US); Daniel R. Gagnon, Lexington, KY (US); Wade A. Powell, Lexington, KY (US); Yimin Guan, Lexington, KY (US); Timothy L. Strunk, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/427,267

(22) PCT Filed: Sep. 12, 2013

(86) PCT No.: PCT/IB2013/002980

§ 371 (c)(1),
(2) Date: Mar. 10, 2015

(87) PCT Pub. No.: WO2014/060845

PCT Pub. Date: Apr. 24, 2014

(65) Prior Publication Data

US 2015/0224784 A1 Aug. 13, 2015

Related U.S. Application Data

(60) Provisional application No. 61/700,013, filed on Sep. 12, 2012.

(51) Int. Cl.
*B41J 2/15* (2006.01)
*B41J 2/175* (2006.01)
(Continued)

(52) U.S. Cl.
CPC ..... *B41J 2/17596* (2013.01); *B41J 2/1404* (2013.01); *B41J 2/14016* (2013.01); *B41J 2/16535* (2013.01); *B41J 2202/05* (2013.01)

(58) Field of Classification Search
CPC .... B41J 2002/14435; B41J 2002/14419; B41J 2/1433; B41J 2/14; B41J 2/14201; B41J 2/135
(Continued)

(56) References Cited

U.S. PATENT DOCUMENTS 5,897,789 A 4/1999 Weber
7,500,618 B2 3/2009 Fujishiro et al.
(Continued)

FOREIGN PATENT DOCUMENTS

CN 1750935 A 3/2006
CN 102574395 A 7/2012
(Continued)

OTHER PUBLICATIONS

International Search Report of PCT/IB2013/002980 dated Oct. 4, 2014.
(Continued)

*Primary Examiner* — Lamson Nguyen
(74) *Attorney, Agent, or Firm* — Amster, Rothstein & Ebenstein, LLP

(57) ABSTRACT

An ejection chip is disclosed, and comprises a substrate, a flow feature layer, a nozzle plate, and one or more valves. The substrate includes one or more fluid channels and one or more fluid ports each in communication with at least one of the one or more fluid channels. The flow feature layer is disposed over the substrate, and the flow feature layer include one or more flow features each in communication with at least one of the one or more fluid ports.

18 Claims, 8 Drawing Sheets

(51) Int. Cl.
*B41J 2/14* (2006.01)
*B41J 2/165* (2006.01)

(58) Field of Classification Search
USPC ..... 347/47, 64–65
See application file for complete search history.

(56) References Cited

U.S. PATENT DOCUMENTS

| | | | | |
|---|---|---|---|---|
| 8,616,240 | B2 * | 12/2013 | Taga | B41J 2/055 137/854 |
| 2011/0169897 | A1 | 7/2011 | Yokoyama et al. | |
| 2011/0261123 | A1 | 10/2011 | Mehta et al. | |

FOREIGN PATENT DOCUMENTS

| | | | |
|---|---|---|---|
| EP | 0109239 | A1 | 5/1984 |
| EP | 2442983 | B1 | 2/2015 |
| JP | S57-156262 | A | 9/1982 |

OTHER PUBLICATIONS

Written Opinion of the International Searching Authority of PCT/US2013/059480 dated Dec. 10, 2013.

* cited by examiner

MAINTENANCE VALVE FOR FLUID EJECTION HEAD

FIELD

The present invention is directed to apparatuses and methods for controlling fluid flow through ejection chips.

SUMMARY

According to an exemplary embodiment of the present invention, an ejection chip comprises a substrate, a flow feature layer, a nozzle plate, and one or more valves. The substrate includes one or more fluid channels and one or more fluid ports each in communication with at least one of the one or more fluid channels. The flow feature layer is disposed over the substrate, and the flow feature layer includes one or more flow features each in communication with at least one of the one or more fluid ports. The nozzle layer is disposed over the flow feature layer, and the nozzle layer includes one or more nozzles each in communication with at least one of the one or more flow features so that one or more fluid paths are defined by the one or more fluid channels, the one or more fluid ports, the one or more flow features, and the one or more nozzles. The one or more valves selectively impede flow of fluid through the one or more fluid paths.

In exemplary embodiments, the one or more valves are disposed within the substrate.

In exemplary embodiments, the one or more valves are disposed under the substrate.

In exemplary embodiments, the one or more valves impede flow of fluid through select fluid paths of the one or more fluid paths during a maintenance operation.

In exemplary embodiments, the one or more valves impede flow of fluid flow through select fluid paths of the one or more fluid paths during a jetting operation.

In exemplary embodiments, the ejection chip further comprises one or more ejector elements disposed on the substrate.

In exemplary embodiments, the one or more valves comprise a bubble disposed along at least one of the one or more fluid paths.

In exemplary embodiments, the one or more valves selectively impede the flow of fluid through at least one of the one or more fluid ports.

In exemplary embodiments, the one or more valves comprise flexible membranes that selectively impede flow of fluid through at least one of the one or more fluid paths.

In exemplary embodiments, the flexible membranes are formed of an elastomer.

In exemplary embodiments, the ejection chip further comprises a pneumatic channel configured to create a pressure differential along at least one of the one or more fluid paths so that the flexible membrane deflects toward a region of lower pressure.

In exemplary embodiments, the flexible membranes are configured to engage a wall to selectively impede the flow of fluid through at least one of the one or more fluid paths.

In exemplary embodiments, the one or more valves comprise a bimetallic valve.

In exemplary embodiments, the bimetallic valve comprises a plurality of materials each having a different coefficient of thermal expansion.

In exemplary embodiments, the bimetallic valve is configured to be heated such that the bimetallic valve deflects in the direction of the material of the plurality of materials having the lowest coefficient of thermal expansion.

In exemplary embodiments, the bimetallic valve extends substantially across at least one of the one or more fluid ports.

In exemplary embodiments, the bimetallic valve extends entirely across at least one of the one or more fluid ports.

In exemplary embodiments, the bimetallic valve is spaced away from at least one of the one or more fluid ports by one or more mounts.

In exemplary embodiments, at least one of the one or more valves may be a piezoelectric valve or an electrostatic valve.

BRIEF DESCRIPTION OF THE DRAWINGS

The features and advantages of the present invention will be more fully understood with reference to the following, detailed description of illustrative embodiments of the present invention when taken in conjunction with the accompanying figures, wherein.

DETAILED DESCRIPTION OF EMBODIMENTS

Exemplary embodiments of the present disclosure are directed to apparatuses and methods for controlling fluid flow through ejection chips, for example, micro-fluid ejection heads. Ejection chips may be configured to store and/or eject and/or direct fluids, such as ink, therefrom. Ejection chips may be utilized, for example, in inkjet printers.

Ejection chips may be arranged in a variety of configurations to suit particular needs of use. In embodiments, a plurality of ejection chips may be arranged to form a printhead that is movable across a length and/or width of a surface of a medium, such as a sheet of paper, to project fluids sequentially into sections thereon. In such embodiments, a plurality of ejection chips may form a scanning printhead. In embodiments, a plurality of ejection chips may be arranged to form a printhead that may extend substantially the width of a medium. In such embodiments, a plurality of ejection chips may form a pagewide printhead. In pagewide printheads, a substantially greater, for example twenty-fold, number of ejection chips may be present. Accordingly, pagewide printheads may be configured to utilize a greater amount of ink, for example, during maintenance operations.

In embodiments, to facilitate proper and/or continuous performance of the ejection chips that form a printhead, maintenance operations may include passing a wiping member along a portion of ejection chip to draw out contaminated, improper, or otherwise undesirable fluids, to clear debris, and/or to prime such printheads. Exemplary embodiments of such operations are described in U.S. Patent Application Publication No. 2013/0215191. In such embodiments, the wiping member may have the effect of wicking ink through the ejection chip, thus depleting ink from a reserve within or associated with an ejection chip. In embodiments where a wiping operation is performed on a pagewide printhead, a substantial volume of ink may be depleted in this manner, for example, a twenty-fold increase in ink depletion as compared to a scanning printhead. In embodiments, all ejection chips associated with a given printhead may not necessarily require maintenance during a given maintenance operation. Thus, it may be impracticable to selectively wipe certain printheads while isolating others due to close tolerances and/or geometries within a printhead. Accordingly, it may be desirable to provide a micro-electromechanical system (MEMS) to inhibit, e.g., reduce, minimize, and/or prevent, unintended and/or unnecessary loss of ink during maintenance operations.

Figure 1A:
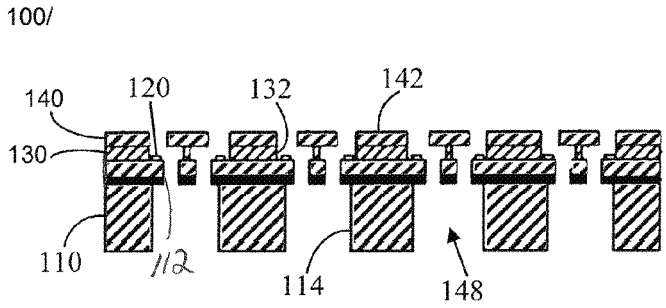
FIG. 1A is a side cross-sectional view of an ejection chip according to an exemplary embodiment of the present disclosure.

Referring to FIG. 1A, an exemplary embodiment of an ejection chip is shown in cross-sectional view and is generally designated as 100. Ejection chip 100 may include a substrate 110, a plurality of fluid ejector elements 120, a flow feature layer 130, and/or a nozzle layer 140. In embodiments, ejection chip 100 may have a different configuration.

Substrate 110 may be formed of a semiconductor material, such as a silicon wafer. One or more fluid ports 112 may be apertures formed along the top surface of the substrate 110 by processing portions of the substrate 110. As described herein, processing portions of an ejection chip may include, for example, mechanical deformation such as grinding, chemical etching, or patterning desired structures with photoresist, to name a few. A back side of the substrate 110 may be processed to form one or more fluid channels 114 in fluid communication with respective fluid ports 112. Fluid channels 114 may be in fluid communication with a supply of ink, such as an ink reservoir.

One or more ejector elements 120 may be disposed on the substrate 110. Ejector elements 120 may be comprised of one or more conductive and/or resistive materials so that when electrical power is supplied to the ejector elements 120, heat is caused to accumulate on and/or near the ejector elements 120. In embodiments, ejector elements 120 may be formed of more than one layered material, such as a heater stack that may include a resistive element, dielectric, and protective layer. The amount of heat generated by ejector elements 120 may be directly proportional to the amount of power supplied to the ejector elements 120. In embodiments, power may be supplied to ejector elements 120 so that a predetermined thermal profile is generated by ejector elements 120, for example, a series of power pulses of constant or variable amplitude and/or duration to achieve intended performance.

A flow feature layer 130 may be disposed over the substrate 110. Flow feature layer 130 may be disposed in a layered or otherwise generally planar abutting, relationship with respect to substrate 110. Flow feature layer 130 may be formed of, for example, a polymeric material. Flow feature layer 130 may be processed such that one or more flow features 132 are formed along and/or within flow feature layer 130. In embodiments, flow features 132 may have geometry and/or dimensioning so that flow features 132 are configured to direct the flow of ink through ejection chip 100.

A nozzle layer 140 may be disposed over the flow feature layer 130. In embodiments, nozzle layer 140 may be disposed in a layered relationship with flow feature layer 130. In embodiments, nozzle layer 140 may be formed of, for example, a polymeric material. Nozzle layer 140 may be processed such that one or more nozzles 142 are formed along a top surface of the nozzle layer 140. Nozzles 142 may be configured as exit apertures for ink being ejected from the ejection chip 100. Accordingly, nozzles 142 may have geometry and/or dimensioning configured to direct the trajectory of ink exiting the ejection chip 100. Respective fluid ports 112, fluid channels 114, flow features 132, and/or nozzles 142 may collectively form fluid paths 148 within the ejector chip 100.

Figure 1B:
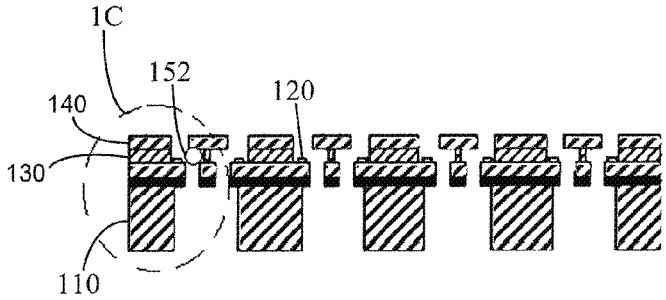
FIG. 1B is a side cross-sectional view of the ejection chip of FIG. 1A having a bubble formed therein.
Figure 1C:
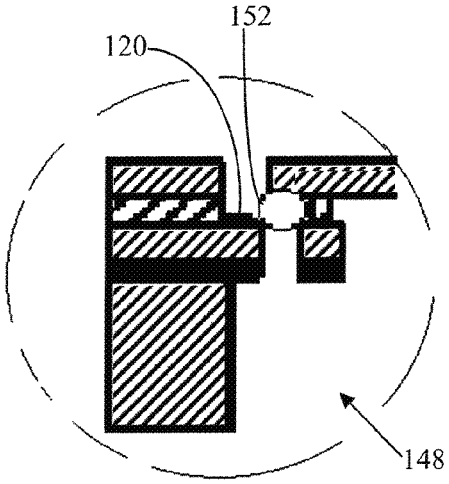
FIG. 1C is an enlarged view of the area of detail identified in FIG. 1B.

Referring additionally to FIGS. 1B and 1C, in use, fluid channels 114 may be at least partially filled with ink. Ink may be any fluid suitable for use in an inkjet printing operation. Power may be supplied to the ejector elements 120 such that ejector elements 120 heat the surrounding ink. Power may be supplied to ejector elements 120 such that a portion of ink 150 is caused to quickly vaporize, such as by flash vaporization, so that one or more vapor bubbles 152 are formed within the fluid channel 114. The vapor comprising bubbles 152 may be formed from the vaporization of an aqueous component of the ink. A high-powered electrical pulse may be provided to form bubbles 152. In embodiments, a series of electrical pulses may be provided to form bubbles 152. Following formation of bubbles 152, electrical power may continue to be supplied to ejector elements 120 at an equal or lesser level than the initial amount of electrical power to form bubbles 152 in order to sustain bubbles 152 within the fluid channel 114. Bubbles 152 tend to expand, e.g., hydraulically, due to their higher energy state within the liquid ink, but are restricted from expanding beyond a given dimension by the walls of the surrounding fluid path 148. Accordingly, bubbles 152 are configured as a pressurized region within fluid path 148 that forms a discontinuity of the liquid ink. In this manner, bubbles 152 may be provided to selectively impede the passage of ink through select fluid paths 148. In embodiments, the relatively lower temperature of the walls of fluid channel 114 compared to bubble 152 may inhibit the expansion of bubble 152 into a fluid-tight seal with the walls of fluid path 148. In such embodiments, bubble 152 may permit some ink to flow through the fluid path 148. In embodiments, bubble 152 may be formed along a different portion of fluid path 148, e.g. a fluid port 112.

When it is desired to permit ink flow through the fluid channel 114, electrical power may be disengaged from ejector elements 120. A reduction in electrical power to ejector elements may cause a reduction in heat near the ejection elements 120 so that bubbles 152 may dissipate, collapse, and/or return to a lower energy state so that the vapor comprising bubbles 152 are absorbed back into the surrounding ink.

In embodiments, electrical power may be supplied to ejector elements 120 to form one or more bubbles 152 during maintenance operations, for example, to inhibit the loss of ink through an ejector chip 100 due to wiping of the ejection chip 100. In such embodiments, a fluid flow controlling member, such as a valve, of the ejection chip 100 may comprise one or more bubbles 152. In such embodiments, one or more valves comprising bubbles 152 have a normally open configuration. In such embodiments, bubbles 152 are normally absent from select fluid paths 148 and are selectively formed along select fluid paths 148, for example, during maintenance operations.

In embodiments, power may be supplied to ejector elements 120 to form bubble 152 within fluid channels 114 in a substantially constant state except for during use of the ejector chip 100 to eject ink onto a medium, such as a jetting operation. In such embodiments, one or more valves of the ejection chip 100 may comprise bubbles 152 having a normally closed configuration. In such embodiments, bubbles 152 are normally present within select fluid paths 148 and are absent during jetting operations. In such embodiments, bubbles 152 may normally be present within select fluid paths 148 so that ink is impeded from entering fluid paths 148 from a location external of an ejection chip, for example, ink that has been splashed or misfired from a nozzle not associated with select fluid paths 148. In this manner, bubbles 152 may be formed to selectively impede contamination of select fluid paths 148.

Turning to FIGS. 2A, 2B, 2C, 2D, 2E, 2F, 2G, and 2H, the fabrication of an exemplary embodiment of an ejection chip, generally designated 200, is shown.

A substrate 210, such as a silicon wafer, may be provided in a first step of a fabrication process. A sacrificial material 220, e.g., a silicon dioxide layer, may be deposited over the substrate 210. The sacrificial material 220 may be processed so that the sacrificial material is patterned over the substrate 210 to correspond to a location of a fluid port 212. A heater metal 230 and a conductor metal 240 may then be deposited over the substrate 210 and sacrificial material 220. Heater metal 230 and conductor metal 240 may be deposited on substrate 210 in a layered configuration. Heater metal 230 and conductor metal 240 may be configured to generate heat upon receiving electrical power. In embodiments, heater metal 230 and/or conductor metal 240 have conductive and/or electrical resistive properties such that electrical power may be transmitted therealong to cause a buildup of heat within and/or around heater metal 230 and/or conductor metal 240. In embodiments, heater metal 230 and conductor metal 240 may be formed from one or more of Si, Al, Ta, W, Hf, Ti, poly-Si, Ni, TiN, and/or TaC, to name a few. The heater metal 230 and conductor metal 240 may be patterned along the surface of substrate 210 so that at least one coextensive region of heater metal 230 and conductor metal 240 is present over the substrate 210. In embodiments, the conductor metal 240 may be etched away in a region of desired heat generation.

Figure 2A:
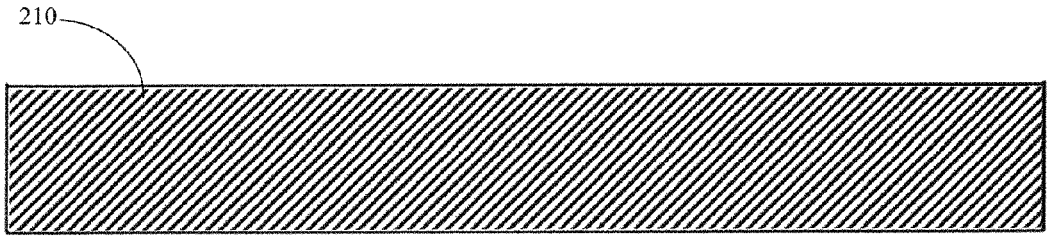
FIG. 2A is a first sequential view of the fabrication of an ejection chip according to an exemplary embodiment of the present disclosure, shown in side cross-section.
Figure 2B:
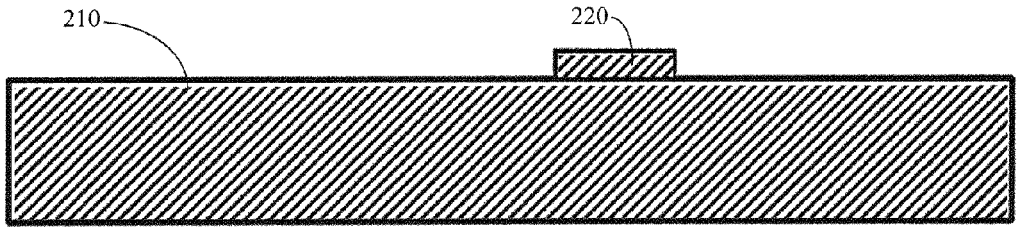
FIG. 2B is a second sequential view of the fabrication of an ejection chip, shown in side cross-section.
Figure 2C:
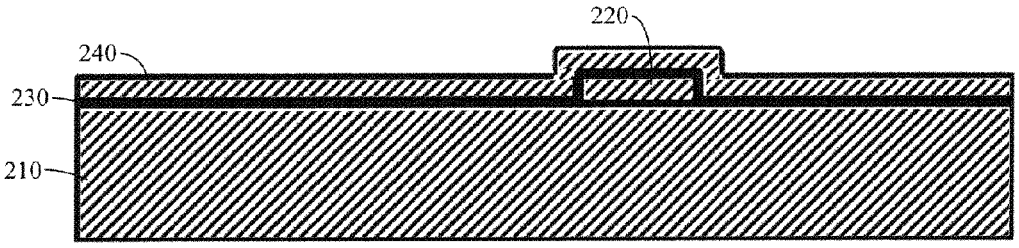
FIG. 2C is a third sequential view of the fabrication of an ejection chip, shown in side cross-section.
Figure 2D:
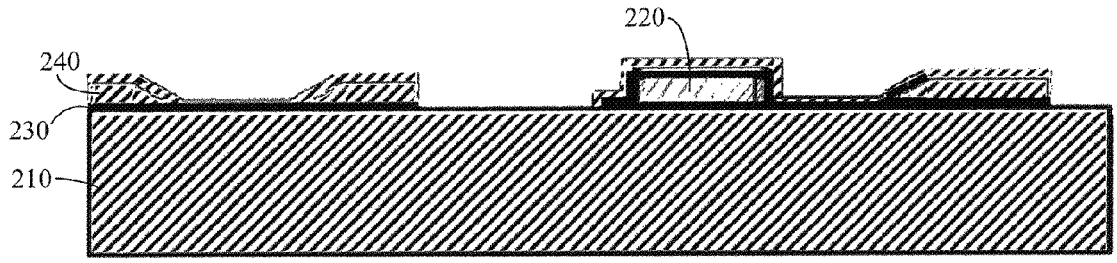
FIG. 2D is a fourth sequential view of the fabrication of an ejection chip, shown in side cross-section.
Figure 2E:
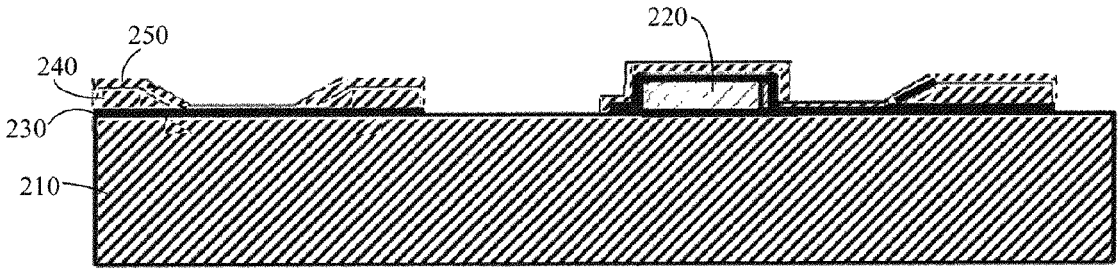
FIG. 2E is a fifth sequential view of the fabrication of an ejection chip, shown in side cross-section.

As shown in FIG. 2E, a heater passivation layer 250 is then deposited on the substrate 210. Heater passivation layer 250 may be formed of, for example, silicon dioxide and/or silicon nitride. Heater passivation layer 250 may be disposed in a layered relationship with at least a portion of the conductor metal 240. Heater passivation layer 250 may be processed so that heater passivation layer 250 is patterned over the conductor layer 240.

Figure 2F:
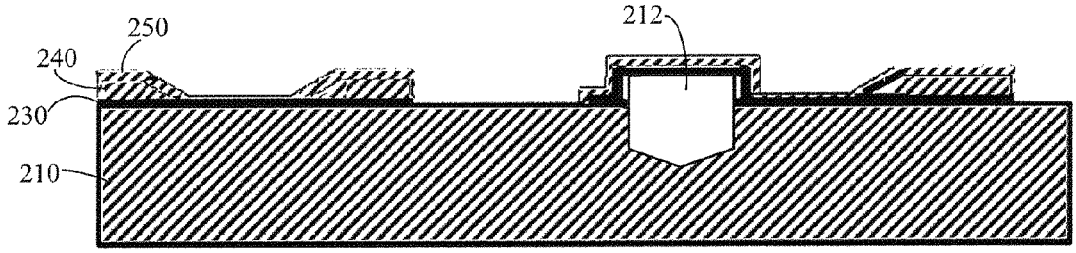
FIG. 2F is a sixth sequential view of the fabrication of an ejection chip, shown in side cross-section.

As shown in FIG. 2F, sacrificial layer 220 may then be processed, for example, etched away using a tetramethylammonium hydroxide (TMAH) etching process. In embodiments, a portion of the substrate 210 is also removed during this process. Processing of the sacrificial layer 220 may cause the formation of one or more fluid ports 212 along the substrate 210.

Figure 2G:
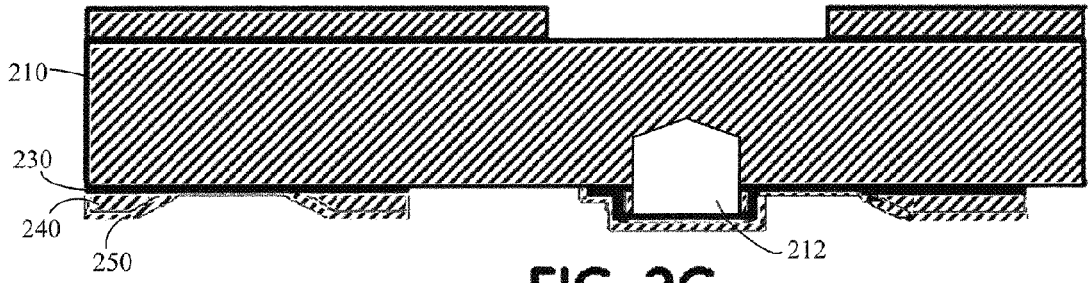
FIG. 2G is a seventh sequential view of the fabrication of an ejection chip, shown in side cross-section.

As shown in FIG. 2G, a bottom surface of the substrate 210 may then be processed so that one or more fluid channels 214 are formed in the substrate 210. Fluid channels 214 may be in fluid communication with one or more respective fluid ports 212.

In embodiments, a flow feature layer including a plurality of flow features may be deposited over the heater passivation layer 150. Such a flow feature layer may be substantially similar to flow feature layer 130 described above. Such a flow feature layer may be processed to form one or more flow features therealong. Such flow features may be in fluid communication with one or more respective fluid ports 212.

In embodiments, a nozzle layer may be deposited over a flow feature layer. Such a nozzle layer may be substantially similar to nozzle layer 280 described above. Such a nozzle layer may be processed so that one or more nozzles are formed therealong. Such nozzles may be in fluid communication with one or more respective flow features of a flow feature layer. In embodiments, nozzles, flow features, fluid channels 214 and/or fluid ports 212 may collectively form fluid paths 216 within ejection chip 200.

Figure 2H:
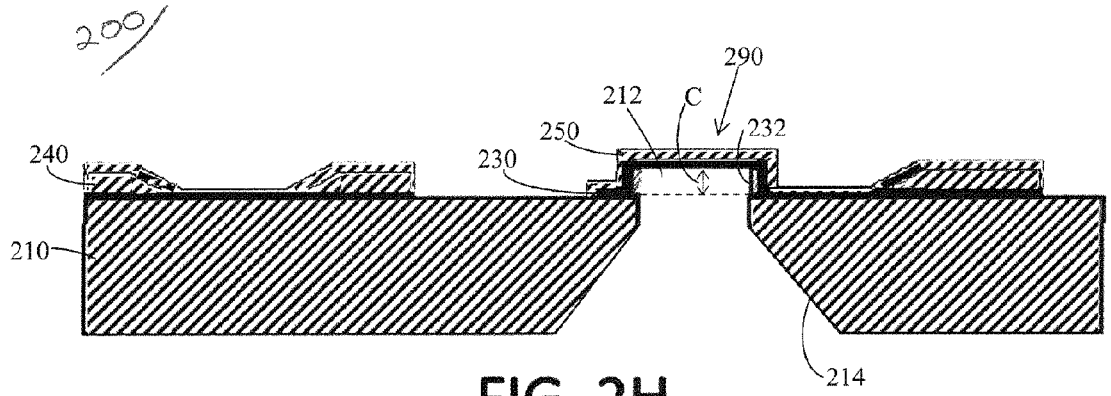
FIG. 2H is a eighth sequential view of the fabrication of an ejection chip, shown in side cross-section.
Figure 2I:
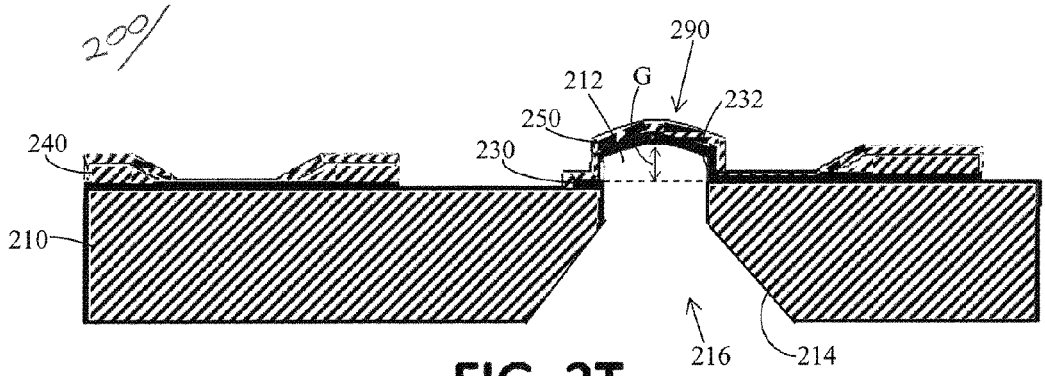
FIG. 2I is a side cross-sectional view of the ejection chip formed in FIGS. 2A-2H, with a valve thereof being actuated.

As shown in FIG. 2H, following the fabrication of ejection chip 200, a portion of heater metal 230 and a portion of passivation layer 250 may extend substantially across a fluid port 214. The portions of heater metal 230 and passivation layer 250 may be spaced away from the surface of the substrate 210, e.g., by one or more mounts 232. In embodiments, mounts 232 may be an unprocessed portion of sacrificial layer 220. In embodiments, mounts 232 may be unetched sidewalls of resistive film and/or dielectric material. Mounts 232 may provide a clearance C between the portions of heater metal 230 and passivation layer 250 and the substrate 210 so that ink may pass through the clearance C. In embodiments, clearance C may be dimensioned to permit a negligible amount of ink to pass therethrough.

Heater metal 230 and passivation layer 250 may have a coextensive arrangement to together form a bimetallic valve 290. In embodiments, conductor metal 240 may alternatively or additionally form a part of bimetallic valve 290. Bimetallic valve 290 may configured such that heater metal 230 and passivation layer 250 are formed of materials having a different coefficient of thermal expansion (CTE) when placed in a substantially similar environment. In embodiments, Si may have a CTE of about 2.5 ppm/° C., $Si_3N_4$ may have a CTE of about 2.8 ppm/° C., $TiO_2$ may have a CTE of about 7.2 to about 7.10 ppm/° C., Al may have a CTE of about 24 to about 27 ppm/° C., Ta may have a CTE of about 6.5 ppm/° C., W may have a CTE of about 4 ppm/° C., Hf may have a CTE of about 5.9 ppm/° C., Ti may have a CTE of about 9.5 ppm/° C., poly-Si may have a CTE of about 9.4 ppm/° C., $SiO_2$ may have a CTE of about 0.5 ppm/° C., SiC may have a CTE of about 2.5 to about 5.5 ppm/° C., Ni may have a CTE of about 13.3 ppm/° C., TiN may have a CTE of about 9.4 ppm/° C., and TaC may have a CTE of about 6.3 ppm/° C., to name a few.

In use, electrical power may be supplied to the ejection chip 200 such that the heater metal 230 and passivation layer 250 are caused to increase in thermal energy so that temperature increases. Due to the different CTEs comprising heater metal 230 and passivation layer 250, increased thermal energy across the bimetallic valve 290 will cause the valve 290 to deflect, such as bend, flex, and/or warp, in the direction of the material having the lower of the two CTEs. Accordingly, the bimetallic valve 290 will deflect away from the fluid port 212. In embodiments, bimetallic valve 290 may define one or more peripheral edges that are not attached to mounts 232. In such embodiments, the bimetallic valve 290 may deflect or bow such that a gap G is formed between an apex of the deflected bimetallic valve 290 and the fluid portion 212. In embodiments, gap G may define a greater space than clearance C measured between bimetallic valve 290 and fluid port 212 when bimetallic valve 290 is in an unactuated, e.g., non-powered state. In embodiments, gap G may permit an increased amount of ink to flow through fluid port 212. In this manner, bimetallic valve 290 may be configured to selectively impede the flow of ink through select fluid channels 216 in the ejection chip 200.

In embodiments, bimetallic valve 290 may substantially impede the flow of ink through select fluid paths 216 in an unactuated state. In such embodiments, bimetallic valve 290 may comprise a normally-closed valve. In this manner, bimetallic valve 290 may be powered, for example, during a jetting operation of the ejection chip 200, to selectively permit the flow of ink through select fluid paths 216 through the ejection chip 200. In such embodiments, the bimetallic valve 290 may be normally closed to inhibit cross-contamination of select fluid paths 216 by impeding the flow of ink or other substances into select fluid paths 216 from an external environment. In embodiments, an ejection chip may utilize a valve having a different actuatable configuration, such as a piezoelectric valve and/or an electrostatic valve.

In embodiments, bimetallic valve 290 may allow the flow of ink through select fluid paths 216 in an unactuated, e.g., resting or unpowered state. In such embodiments, bimetallic valve 290 may comprise a normally-open valve. In this manner, bimetallic valve 290 may be powered, e.g., during a maintenance operation, to selectively impede select fluid paths through the ejection chip 200.

Figure 3A:
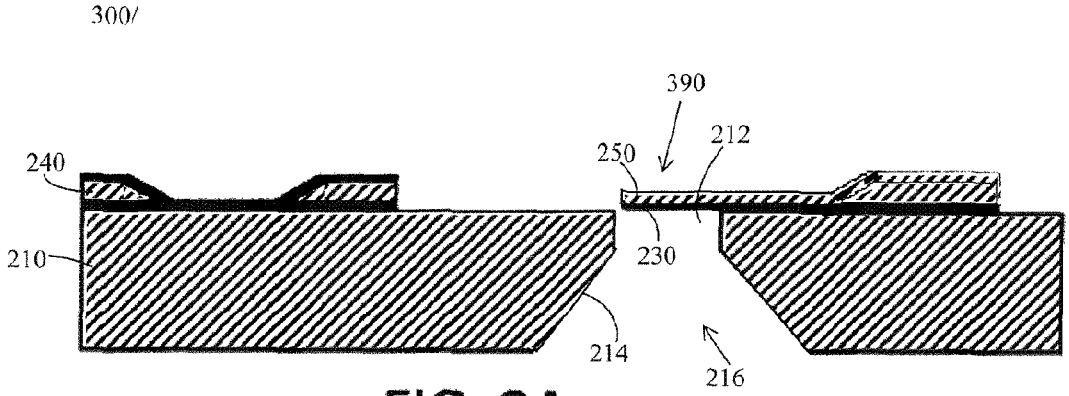
FIG. 3A is a side cross-sectional view of an ejection chip having a valve according to an exemplary embodiment of the present disclosure.
Figure 3B:
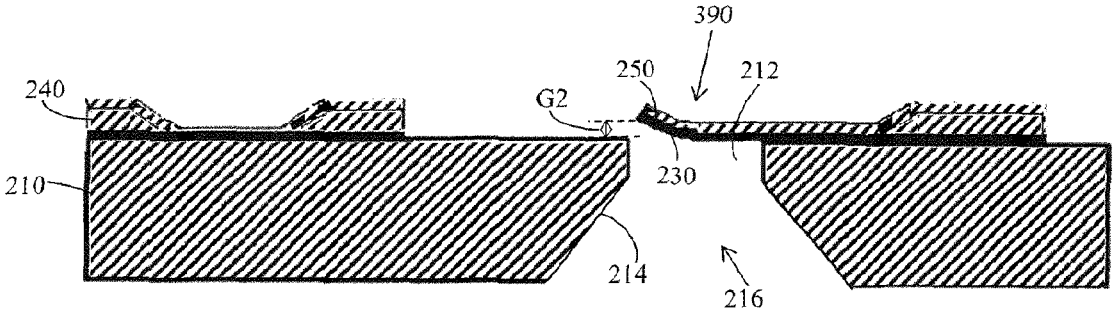
FIG. 3B is a side cross-sectional view of the ejection chip of FIG. 3A, with the valve being actuated.
Figure 4A:
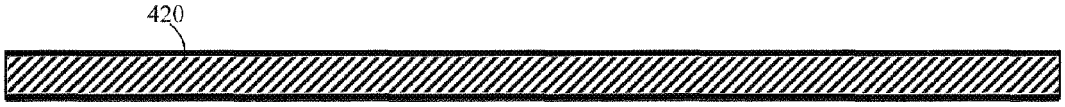
FIG. 4A is a first sequential view of the fabrication of an ejection chip according to an exemplary embodiment of the present disclosure, shown in side cross-section.
Figure 4B:
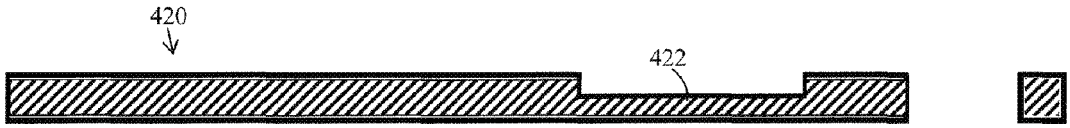
FIG. 4B is a second sequential view of the fabrication of an ejection chip, shown in side cross-section.
Figure 4C:
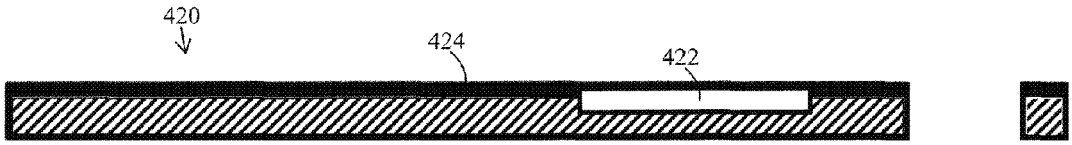
FIG. 4C is a third sequential view of the fabrication of an ejection chip, shown in side cross-section.
Figure 4D:
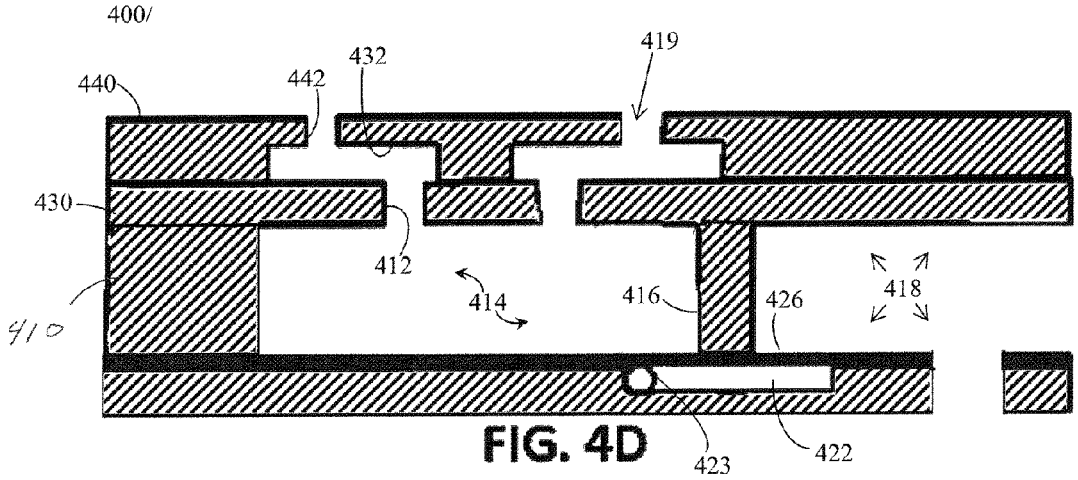
FIG. 4D is a side cross-sectional view of the ejection chip formed in FIGS. 4A-4C, with a valve thereof being actuated.
Figure 4E:
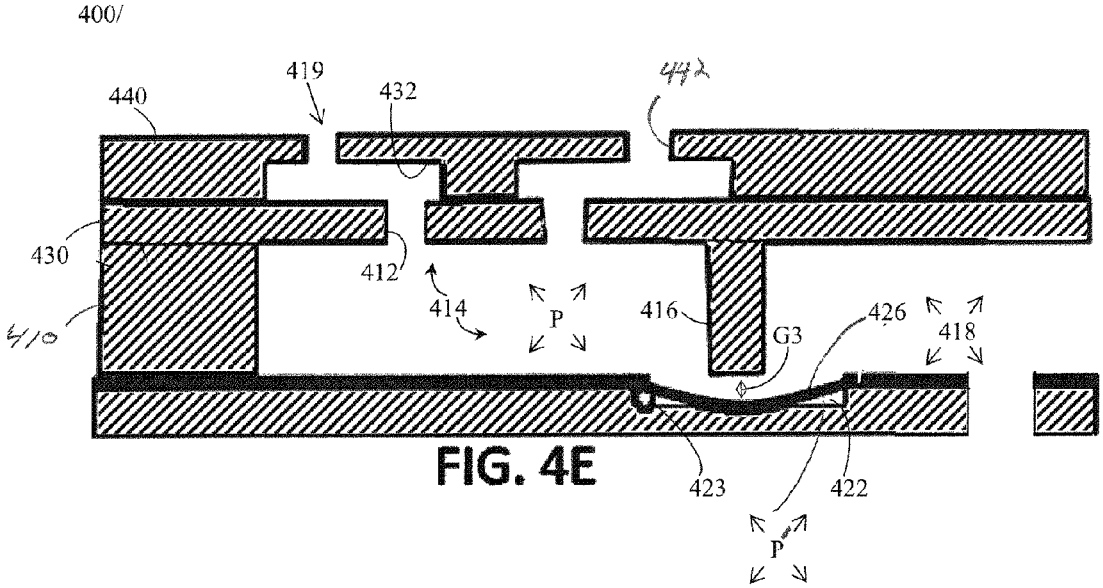

Turning to FIG. 3A, an ejector chip 300 according to an exemplary embodiment of the present disclosure is shown. Ejector chip 300 may be formed in a substantially similar manner to ejector chip 200 described above, and may comprise substantially similar components. In embodiments, heater metal 230 and passivation layer 250 may be processed such that the heater metal 230 and passivation layer 250 together form a flapper valve 390 that extends substantially across the fluid port 212. In embodiments, flapper valve 390 may be configured as a strip of bimetallic material. Flapper valve 390 may have a cantilevered configuration, e.g., flapper valve may be attached to one side of a fluid port 212 and have a free end extending across the fluid port 212. Flapper valve 390 may be positioned in a layered relationship with the substrate 210 and may extend between or beyond the edges of fluid port 212. Accordingly, ejection chip 300 may be devoid of mounts 232 for flapper valve 390. In embodiments, flapper valve 390 may extend partially across the fluid port 212 so flapper valve 390 may have a terminus spaced between the edges of fluid port 212. The generally planar abutting relationship of the flapper valve 390 and the fluid port 212 may provide a substantially fluid-tight seal between the flapper valve 390 and the fluid port 212 so that ink is substantially inhibited from flowing through fluid port 212 when flapper valve 390 is in place in a resting position.

Similar to ejection chip 200 above, heater metal 230 and passivation layer 250 may each have a different CTE. Accordingly, heater metal 230 and passivation layer 250 may be powered such that thermal energy increases across flapper valve 390 such that the flapper valve 390 deflects in the direction of the material having the lower CTE. Because the flapper valve 390 includes a free end that is not attached at one end of the fluid port 212, the flapper valve 390 may deflect away from the fluid port 212 such that a gap G2 is formed between an end of the flapper valve 390 and the fluid port 212. Accordingly, the flapper valve 390 may be actuated to permit the flow of ink through the fluid port 212.

In embodiments, flapper valve 390 may substantially impede the flow of ink through select fluid paths 216 in an unactuated state. In such embodiments, flapper valve 390 may comprise a normally-closed valve. In this manner, flapper valve 390 may be powered, e.g., during a jetting operation of the ejection chip 300, to selectively open select fluid paths 216 through the ejection chip 300 during jetting, and flapper valve 390 may be configured to selectively impede select fluid paths 216 through the ejection chip 300 in other states. In embodiments, an ejection chip may utilize a valve having a different actuatable configuration, such as a piezoelectric valve and/or an electrostatic valve.

In embodiments, flapper valve 390 may allow the flow of ink through select fluid paths 216 in an unactuated state. In such embodiments, flapper valve 390 may comprise a normally-open valve. In this manner, flapper valve 390 may be powered, for example, during a maintenance operation, to selectively impede select fluid paths 216 through the ejection chip 300.

Referring to FIGS. 4A, 4B, 4C, and 4D, fabrication of an ejection chip assembly 400 according to an exemplary embodiment of the present disclosure is shown. Ejection chip assembly 400 includes a substrate 410. Substrate 410 may be substantially similar to substrates 110 and 210 described above, for example, substrate 410 may be a silicon wafer. Substrate 410 may be processed to define one or more fluid ports 412 and one or more fluid channels 414. The one or more fluid ports 412 may be in fluid communication with the one or more fluid channels 414. Substrate 410 may also include a restrictor 416, as will be described further herein. In embodiments, restrictor 416 may form a partition between one or more fluid channels 414 and a respective fluid chamber 418.

A valve substrate 420 may be affixed to a bottom portion of the substrate 410. Valve substrate 420 may be formed from a variety of materials, such as silicon, glass, liquid crystal polymer, or plastic, to name a few. Valve substrate 420 may be positioned along one or more fluid channels 414 of substrate 410 so that valve substrate 420 at least partially encloses one or more of the fluid channels 414. Valve substrate 420 may be processed to form a displacement chamber 422 thereon. A flexible membrane 424 may be laminated on top of the valve substrate 420 such that a portion of flexible membrane 424 covers displacement chamber 422 to form a flexible valve 426 disposed under the substrate 410. One or more flexible valves 426 may be disposed across the displacement chamber 414. Flexible valve 426 may be formed of a polymeric material, such as polydimethylsiloxane, perfluoropolyether, polytetrafluoroethylene, or fluorinated ethylene-propylene, to name a few. In embodiments, flexible valve 426 may be an elastomer.

Restrictor 416 may be a portion, such as a wall, of substrate 410 that extends toward the displacement chamber 422. Restrictor 416 may be positioned such that the restrictor 416 engages to contact and/or substantially abut the flexible valve 426. Restrictor 416 may extend toward the flexible valve 426 in a substantially transverse manner. In embodiments, restrictor 416 may contact or substantially abut the flexible valve 426 such that the flexible valve 426 is maintained in a substantially planar configuration by the presence of restrictor 416. In this manner, restrictor 416 may fluidly isolate an ink chamber 418 from a fluid channel 414.

A flow feature layer 430 may be disposed over the substrate 410. Flow feature layer 430 may be substantially similar to flow feature layer 130 described herein. Flow feature layer 430 may be processed such that flow feature layer 430 includes one or more flow features 432. Flow features 432 may be in selective fluid communication with one or more respective fluid ports 412, as will be described further herein. Flow features 432 may be in fluid communication with one or more fluid ports 412 and one or more fluid channels 414 and one or more fluid chambers 418.

A nozzle layer 440 may be disposed over the flow feature layer 430. Nozzle layer 440 may be substantially similar to nozzle layer 140 described above. Nozzle layer 440 may be processed such that nozzle layer 440 includes one or more nozzle 442 formed therealong. Each nozzle 442 may be in fluid communication with one or more respective flow feature 432. In embodiments, nozzles 442, flow features 432, fluid ports 412, fluid channels 414 and/or fluid chamber 418 may collectively form a fluid path 419 within ejection chip assembly 400.

Displacement chamber 422 may be fluidly coupled with a pneumatic channel 423, such as a source of vacuum. Accordingly, pneumatic channel 423 may be configured to change a pressure P of fluids, such as air, within the displacement chamber 423. In an initial or valve closed state, a fluid pressure P between the substrate 410 and flow feature layer 430, for example, along a fluid channel 414, may be substantially similar to fluid pressure P in the displacement chamber 422.

In use, pneumatic channel 423 may be actuated, e.g., powered by a pump or other source of vacuum, such that fluids are withdrawn from displacement chamber 422. As fluid pressure within the displacement chamber 422 decreases, an at least partial vacuum is formed such that a fluid pressure P' is formed in the displacement chamber 422. Fluid pressure P' may be different, e.g., lower, than fluid pressure P between the substrate 410 and the valve substrate 420. Accordingly, a pressure differential on either side of the flexible valve 426 may cause the flexible valve 426 to deflect away from the restrictor 416 toward the region of lower pressure P' such that a gap G3 is formed between the restrictor 416 and the flexible valve 426. In this manner, gap G3 permits ink to flow between the fluid port 412 and the flow features 432 along the fluid channel 414. The deflected flexible valve 426 may comprise a valve open condition of the ejection chip assembly 400.

To return the flexible valve 426 to the closed condition, pneumatic channel 423 may be disengaged, for example, removed or shut down, from the displacement chamber 422 so that the fluid pressure in the displacement chamber 422 and the fluid pressure between the substrate 410 and valve substrate 420 substantially equalizes. In the absence of a pressure differential, flexible valve 426 may return to its resting, generally planar condition, such that the flexible valve 426 contacts or abuts the restrictor 416 so that ink is inhibited from flowing between the fluid chamber 418 and fluid channel 414. In embodiments, flexible valve 426 may have a resilient configuration such that flexible valve 426 is maintained under a bias to return to its resting condition. In embodiments, pneumatic channel 423 may be configured to deliver fluid pressure to create a positive pressure environment to facilitate the return of flexible valve 426 to its resting condition. In this manner, flexible valve 426 may be configured to selectively impede fluid flow through select fluid paths 419 through ejection chip assembly 400 in a resting condition, such as a normally closed valve.

Figure 5A:
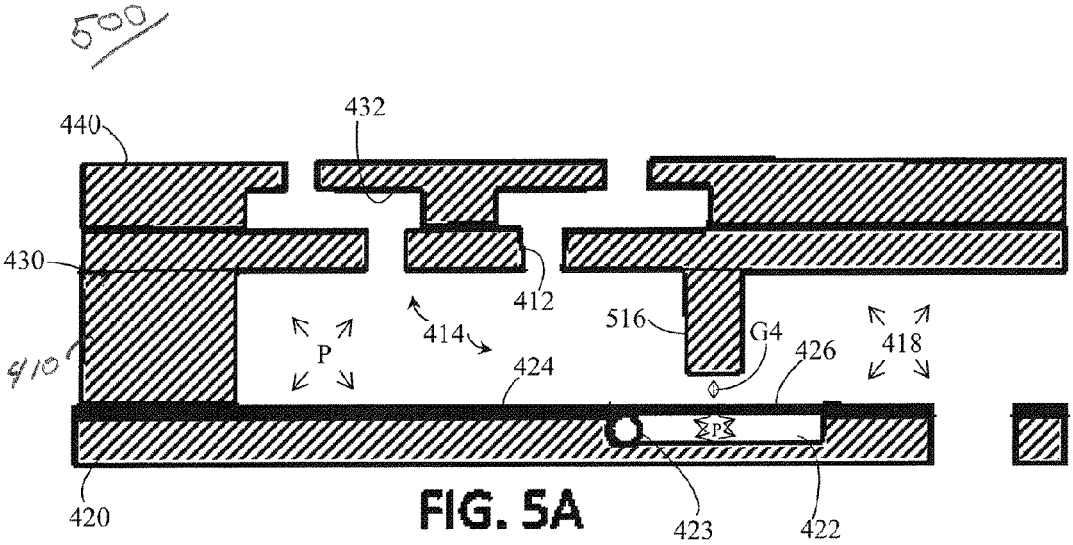
FIG. 5A is a side cross-sectional view of an ejection chip according to an exemplary embodiment of the present disclosure.

Turning to FIG. 5A, an ejection chip assembly according to an embodiment of the present disclosure is generally designated as 500. Ejection chip assembly 500 may include substantially similar components to ejection chip assembly 400 described above, such as nozzle layer 440, flow feature layer 430 and/or valve substrate 420.

Ejection chip assembly 500 may include a substrate 510 that is similar to substrate 410. Substrate 510 may include a restrictor 516 that extends toward displacement chamber 422. Restrictor 516 may be positioned with respect to flexible valve 426 such that a gap G4 is present between the restrictor 516 and the flexible valve 426 in a resting condition of the flexible valve 426.

Figure 5B:
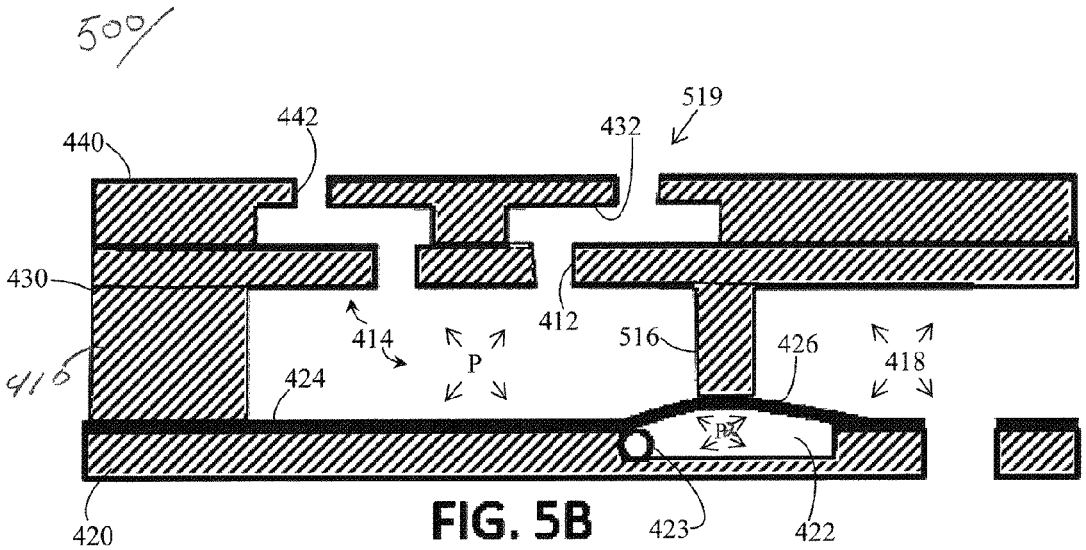
FIG. 5B is a side cross-sectional view of the ejection chip of FIG. 5B, with a valve thereof being actuated.

Referring additionally to FIG. 5B, to actuate flexible valve 426, pneumatic channel 423 may supply fluid pressure, e.g., positive air pressure, to displacement chamber 422 such that a pressure P2 is formed within displacement chamber 422. Pressure P2 may be different, e.g., greater than a pressure P formed along the fluid channel 414 so that a pressure differential is present within ejection chip assembly 500. The pressure differential may cause the flexible valve 426 to deflect toward the region of lower pressure P so that the flexible valve 426 is urged into contact to form a substantially fluid tight seal with restrictor 516 so that ink is inhibited from flowing past the restrictor 516.

In this manner, a flexible valve 426 may be provided so that the flexible valve 426 is normally positioned to allow ink flow through the ejection chip assembly 500 and may be actuated to substantially impede ink flow through select fluid paths 519 of the ejection chip assembly 500, such as a normally open valve.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An ejection chip comprising:

a substrate that includes one or more fluid channels and one or more fluid ports each in communication with at least one of the one or more fluid channels;

a flow feature layer disposed over the substrate, the flow feature layer include one or more flow features each in communication with at least one of the one or more fluid ports;

a nozzle plate disposed over the flow feature layer, the nozzle plate including one or more nozzles each in communication with at least one of the one or more flow features so that one or more fluid paths are defined by the one or more fluid channels, the one or more fluid ports, the one or more flow features, and the one or more nozzles; and one or more valves directly secured at opposite ends of the one or more fluid ports and that selectively impede flow of fluid through the one or more fluid paths.

2. The ejection chip of claim 1, wherein the one or more valves are disposed under the substrate.

3. The ejection chip of claim 1, wherein the one or more valves are disposed over the substrate.

4. The ejection chip of claim 1, wherein the one or more valves impede flow of fluid through select fluid paths of the one or more fluid paths during a maintenance operation.

5. The ejection chip of claim 1, wherein the one or more valves impede flow of fluid flow through select fluid paths of the one or more fluid paths during a jetting operation.

6. The ejection chip of claim 1, further comprising one or more ejector elements disposed on the substrate.

7. The ejection chip of claim 1, wherein at least one of the one or more valves selectively impede flow of fluid at the one or more fluid ports.

8. The ejection chip of claim 1, wherein the one or more valves comprise flexible membranes that selectively impede flow of fluid into the one or more fluid paths.

9. The ejection chip of claim 8, wherein the flexible membranes are formed of an elastomer.

10. The ejection chip of claim 8, further comprising a pneumatic channel configured to create a pressure differential along at least one of the one or more fluid paths so that the flexible membrane deflects toward a region of lower pressure.

11. The ejection chip of claim 8, wherein the flexible membranes are configured to engage a wall to selectively impede the flow of fluid along at least one of the one or more fluid paths.

12. The ejection chip of claim 1, wherein the one or more valves comprise a bimetallic valve.

13. The ejection chip of claim 12, wherein the bimetallic valve comprises a plurality of materials each having a different coefficient of thermal expansion.

14. The ejection chip of claim 13, wherein the bimetallic valve is configured to be heated such that the bimetallic valve deflects in the direction of the material of the plurality of materials having the lowest coefficient of thermal expansion.

15. The ejection chip of claim 12, wherein the bimetallic valve extends entirely across at least one of the one or more fluid ports.

16. The ejection chip of claim 12, wherein the bimetallic valve is spaced away from the one or more fluid ports by one or more mounts.

17. The ejection chip of claim 1, wherein at least one of the one or more valves may be a piezoelectric valve or an electrostatic valve.

18. An ejection chip comprising:

a substrate that includes one or more fluid channels and one or more fluid ports each in communication with at least one of the one or more fluid channels;

a flow feature layer disposed over the substrate, the flow feature layer comprises one or more flow features each in communication with at least one of the one or more fluid ports;

a nozzle plate disposed over the flow feature layer, the nozzle plate comprises one or more nozzles each in communication with at least one of the one or more flow features so that one or more fluid paths are defined by the one or more fluid channels, the one or more fluid ports, the one or more flow features, and the one or more nozzles; and one or more valves comprising a bubble of evaporated fluid that forms a fluid discontinuity to selectively impede a flow of fluid through the one or more fluid paths.

* * * * *